US005740855A

United States Patent [19]

Eriksson et al.

[11] Patent Number: 5,740,855

[45] Date of Patent: Apr. 21, 1998

[54] DEVICE FOR SLOWING DOWN A MELT DURING CONTINUOUS CASTING OF BILLETS OF BLOOMS

[75] Inventors: Jan Erik Eriksson, Västerås; Magnus Hallefält, Ängelholm; Sten Kollberg; Anders Lehman, both of Västerås, all of Sweden

[73] Assignee: ASEA Brown Boveri AB, Vasteras, Sweden

[21] Appl. No.: 809,485

[22] PCT Filed: Sep. 11, 1995

[86] PCT No.: PCT/SE95/01019

§ 371 Date: Mar. 17, 1997

§ 102(e) Date: Mar. 17, 1997

[87] PCT Pub. No.: WO96/09131

PCT Pub. Date: Mar. 28, 1996

[30] Foreign Application Priority Data

Sep. 20, 1994 [SE] Sweden ..... 9403141

[51] Int. Cl.[6] ..... B22D 27/02

[52] U.S. Cl. ..... 164/502; 164/466

[58] Field of Search ..... 164/502, 503, 164/504, 466, 467, 468, 498, 499, 500, 147.1, 420

[56] References Cited

U.S. PATENT DOCUMENTS 4,986,340 1/1991 Eriksson .

FOREIGN PATENT DOCUMENTS

| | | | |
|---|---|---|---|
| 63-268538 | 11/1988 | Japan | 164/503 |
| 1156842 | 5/1985 | Russian Federation | 164/504 |
| 459401 | 7/1989 | Sweden . | |

*Primary Examiner*—Kuang Y. Lin

*Attorney, Agent, or Firm*—Pollock, Vande Sande & Priddy

[57] ABSTRACT

A device for slowing down the non-solidified portions of a cast strand during continuous casting of billets or blooms. The device comprises a group of at least three separate molds (1–4) which are open in the direction of casting and which are arranged such that each one is supplied with a flow of melt. The device also comprises a number of magnetic core parts (5–8), and at least one magnetic-field generating member (9–13), adapted to generate and transfer, together with the magnetic core parts, a static magnetic field or a periodic low-frequency magnetic field to the inflowing melt in such a way that the movement of the melt is slowed down. The magnetic core parts and the magnetic-field generating members are arranged such that, together with all the molds in the group, they form a common closed magnetic circuit. All the molds included in the group are arranged in series with each other in the closed magnetic circuit.

5 Claims, 2 Drawing Sheets

DEVICE FOR SLOWING DOWN A MELT DURING CONTINUOUS CASTING OF BILLETS OF BLOOMS

TECHNICAL FIELD

The present invention relates to a device for slowing down the non-solidified portions of a cast strand during continuous casting of billets or blooms. The device comprises a plurality of moulds which are open in the direction of casting. The moulds are arranged to be supplied each with a flow of melt. The device comprises at least one member for generating a static magnetic flux or a periodic low-frequency magnetic flux to act in the path of the inflowing melt in such a way that the movement of the melt is slowed down, and a plurality of magnetic core parts arranged to form a closed magnetic circuit together with the moulds.

BACKGROUND OF THE INVENTION

During continuous casting, hot melt flows into a mould which is open in the direction of casting. In the mould the melt is cooled so as to form a solidified, self-supporting surface layer before the cast strand leaves the mould. If inflowing melt is allowed to flow into the mould in an uncontrolled manner, it will penetrate deep down into the non-solidified portions of the cast strand. This renders difficult the separation of unwanted particles contained in the melt. In addition, the self-supporting surface layer is weakened, which increases the risk of melt breaking through the surface layer formed in the mould.

It is previously known to arrange one or more static magnetic fields or periodic low-frequency magnetic fields in the path of the melt to slow down and distribute the inflowing melt and to prevent deposits of unwanted particles, or melting on the inside of the solidified shell, or other drawbacks. The static magnetic field or the periodic low-frequency magnetic field is generated by means of magnets, which, for example, may consist of permanent magnets or coils with magnetic cores, supplied with current.

To slow down the incoming melt during casting of slabs, that is, sheet blanks, usually one or more magnets are arranged on two opposite sides of the strand, and the magnetic flux is returned via an outer return conductor arranged between the magnets. From Swedish patent specification 8604456-7, corresponding to U.S. Pat. No. 4,986,340 a device for slowing down a flow entering a mould, which is divided for the purpose of obtaining two separate cast strands, is previously known. The cast strands are separated by means of an intermediate section, for example a cooled copper body. On either side of the divided mould, a magnet is arranged in the form of a coil and a core. The magnets are arranged such that both mould parts are included in a common magnetic circuit and the mould parts are placed in series with each other.

A device for casting billets or blooms, that is, wire blanks or tube blanks, usually comprises several moulds. A device for casting billets normally comprises between four and eight moulds. Arranging for each mould, in the same way as for slabs, at least one magnet on each of two opposite sides of the strand, and then returning the magnetic flux via an outer return conductor arranged between the magnets, is both costly and space-demanding and is therefore not applicable to casting devices comprising more than two moulds.

Since there is normally a shortage of space in the casting device, it is important that the magnets be as small as possible. The closer to the mould a magnet is placed, the smaller it needs to be, due to the leakage flux becoming smaller. If the magnet is placed some distance away from the mould, it must be made stronger to compensate for the leakage flux if the same magnetic flux is to be obtained in the mould. The fact that the core becomes saturated at a certain magnetic flux puts a lower limit to the size of the core. A stronger magnet therefore needs a larger core to avoid that the core becomes saturated. In the above-mentioned divided mould, the separated moulds share two magnets. If two separate moulds placed somewhat spaced-apart are arranged with magnets in a corresponding way, the distance between the mould and the magnet becomes so large that the leakage flux causes the magnets to be stronger and hence become larger and more space-demanding. The patent specification mentioned above gives no hint as to how the flow in more than two moulds separated from each other is to be slowed down.

SUMMARY OF THE INVENTION

It is an object of the invention to suggest a device for slowing down the non-solidified portions of cast strand during continuous casting with more than two separate moulds, which device is compact and hence may be placed in a small space and which, in addition, is relatively inexpensive to manufacture.

DETAILED DESCRIPTION OF THE PREFERRED EMBODIMENTS

Figure 1:
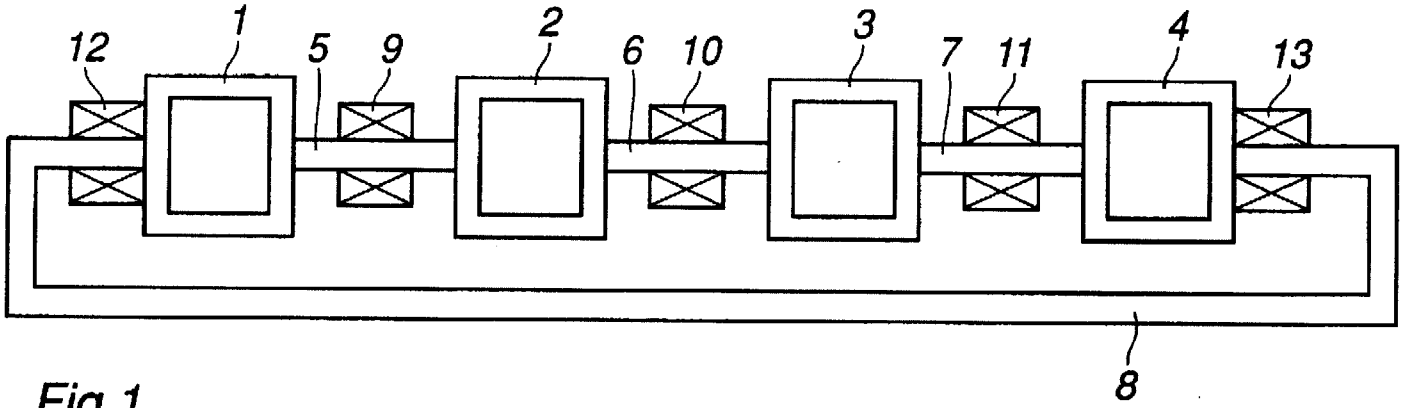
FIG. 1 schematically shows a device for continuous casting of billets according to the invention.

FIG. 1 shows a horizontal section through a first embodiment of a device for slowing down the non-solidified portions of a cast strand during continuous casting of billets. The device comprises four separate moulds 1–4, open at both ends of the direction of casting, with a substantially square cross section. The moulds are arranged in a row at a certain distance to each other. All four moulds are connected into a common magnetic circuit where the moulds are connected in series with each other.

Each mould has a magnet arranged on each of two opposite sides of the mould in such a way that the magnetic field acts across the casting direction in the path of the melt flowing into the mould. Each pair of adjacently placed moulds has a magnet arranged therebetween. Each one of the magnets which are divided by two moulds comprises a core part 5, 6, 7 of a magnetic material, and a coil 9, 10, 11 wound around the core part. Between the first mould 1 and the last mould 4 in the row, a magnetic core part 8 is arranged which also serves as a return conductor of the magnetic flux. Two coils 12 and 13, together with the core part/return conductor 8, constitute two magnets, one of the coils, 12, being arranged close to the first mould 1 in the row, and the other coil 13 being arranged close to the last mould 4 in the row.

One advantage of the invention is that it may be made small and compact because it contains a few small coils and small core parts. The coils and the core parts may be made small because the magnets are arranged close to the moulds.

Figure 2:
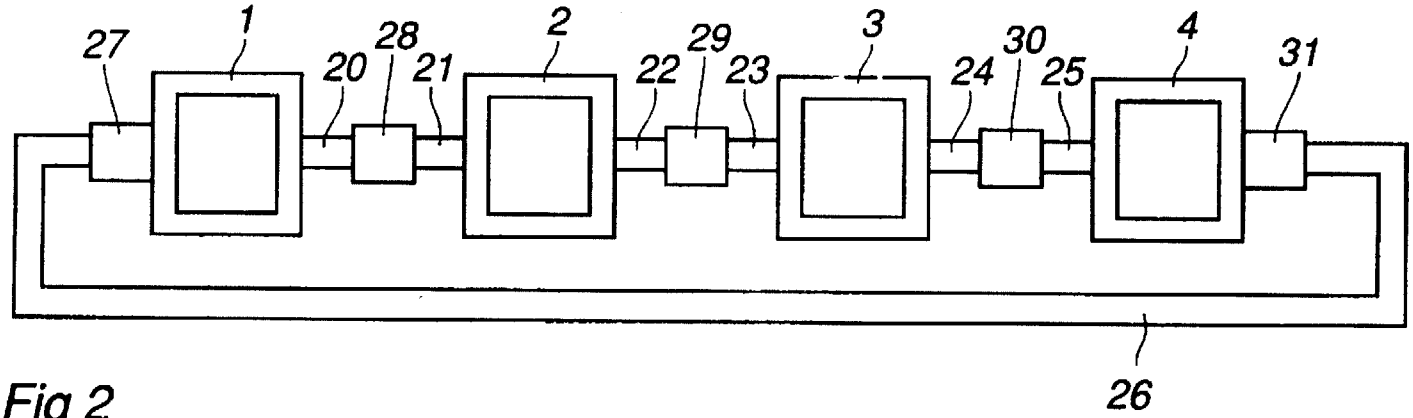
FIGS. 2 and 3 schematically show two embodiments of the invention.

FIG. 2 shows a second embodiment of the invention in which the magnets consist of permanent magnets. Close to the first mould 1 in the row, a permanent magnet 27 is arranged. Each pair of moulds arranged side by side has a permanent magnet 28, 29, 30 arranged therebetween. The embodiment shown in FIG. 2 has magnetically conducting core parts 20–25 arranged between the moulds and the permanent magnets to conduct the magnetic flux between the permanent magnet and the mould. In another embodiment, the permanent magnet may extend all the way between the moulds, and the core parts 20–25 may then be omitted. Close to the last mould 4 in the row, a permanent magnet 31 is arranged. Between the first 1 and last moulds 4 in the row, a magnetic core 26 is arranged, and this core also acts as a return conductor of the magnetic flux.

Figure 3:
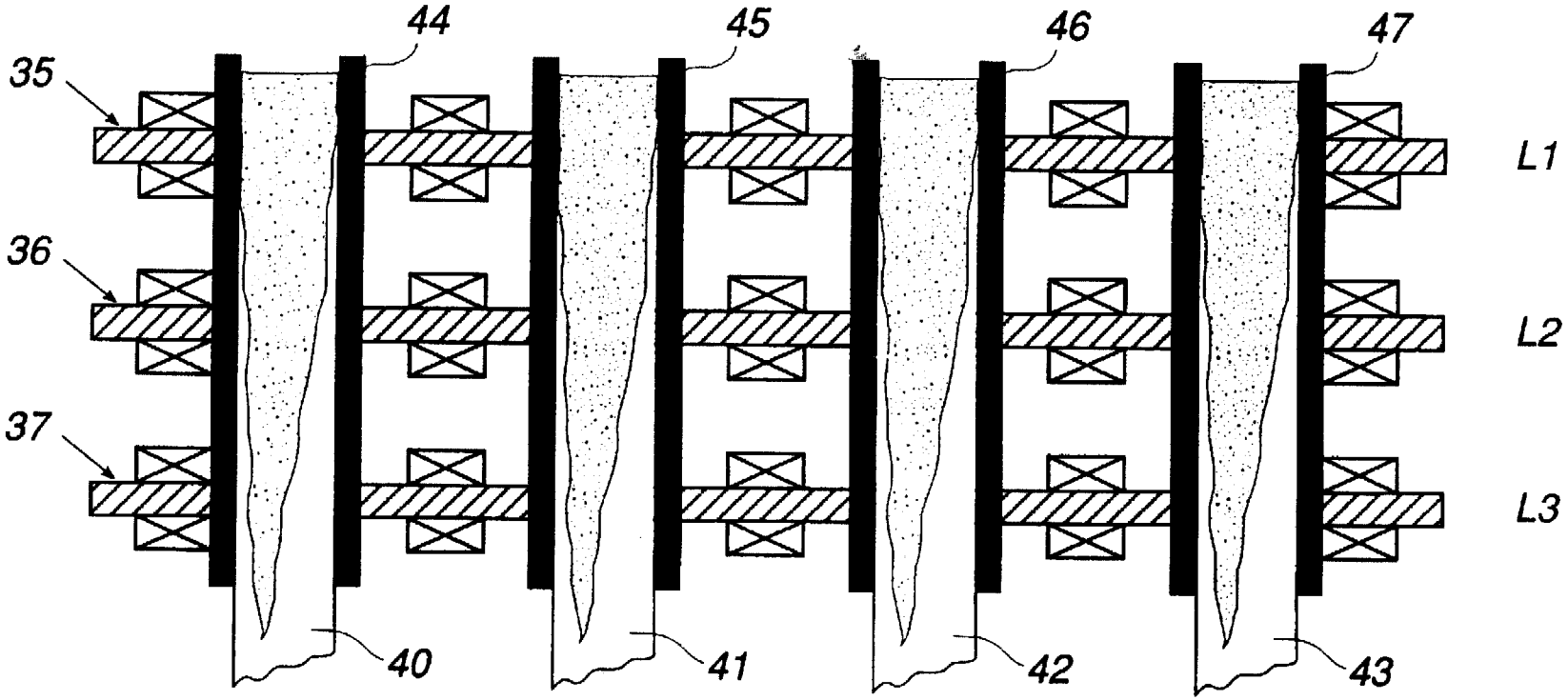

FIG. 3 shows a vertical section through a device for continuous casting of metal comprising three devices for slowing down melt according to the first embodiment, 35, 36, 37. These devices are adapted to generate and apply static magnetic fields or periodic low-frequency magnetic fields to act on the non-solidified portions of four cast strands, 40–43, at three levels L1, L2, L3 arranged one after the other in the direction of casting. The device comprises four moulds 44–47 which are open at both ends of the direction of casting.

We claim:

1. A device for slowing down the non-solidified portions of cast strands during continuous casting of billets or blooms in a plurality of moulds which are open in the direction of casting and which are each adapted to be supplied with a flow of melt, the device comprising:

a number of magnetic core parts adapted, together with the moulds, to form a closed magnetic circuit, at least one magnetic-field generating member, adapted, together with the magnetic core parts, to generate and transfer a static magnetic field or a periodic low-frequency magnetic field to the inflowing melt in such a way that the movement of the melt is slowed down, wherein between each pair of adjoining moulds, in a group of at least three separate moulds, one of said magnetic-field generating members is arranged, and wherein the magnetic core parts and the magnetic-field generating members are arranged to form, together with all the moulds in the group, a common closed magnetic circuit.

2. A device according to claim 1, wherein all the moulds included in the group are arranged in series with each other in the closed magnetic circuit.

3. A device according to claim 1 wherein a magnetic core part is arranged between the first and the last mould in the row in such a way that the magnetic flux is returned from the last to the first mould.

4. A device according to claim 1 wherein the moulds have a substantially square cross section.

5. A device according to claim 1, wherein said device further comprises at least two devices for slowing down melt, which are adapted to generate and apply static magnetic fields or periodic low-frequency magnetic fields to act on the non-solidified portions of the cast strands at at least two levels, arranged one after the other in the direction of casting.

* * * * *

UNITED STATES PATENT AND TRADEMARK OFFICE

CERTIFICATE OF CORRECTION

PATENT NO. : 5,740,855
DATED : April 21, 1998
INVENTOR(S): JAN ERIK ERIKSSON et al.

It is certified that error appears in the above-identified patent and that said Letters Patent is hereby corrected as shown below:

In the title, column [54] change:
"BILLETS OF BLOOMS" to --BILLETS OR BLOOMS--.

Column 1, line 3, change
"BILLETS OF BLOOMS" to --BILLETS OR BLOOMS--.

Signed and Sealed this

Sixteenth Day of June, 1998

*Attest:*

*Attesting Officer*

BRUCE LEHMAN

*Commissioner of Patents and Trademarks*